US007874865B2

(12) United States Patent
Tobey

(10) Patent No.: US 7,874,865 B2
(45) Date of Patent: Jan. 25, 2011

(54) ELECTRICAL CONNECTOR WITH A COMPLIANT CABLE STRAIN RELIEF ELEMENT

(75) Inventor: Shawn Phillip Tobey, Trinity, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/485,457

(22) Filed: Jun. 16, 2009

(65) Prior Publication Data

US 2009/0318033 A1 Dec. 24, 2009

Related U.S. Application Data

(63) Continuation-in-part of application No. 12/143,291, filed on Jun. 20, 2008, now Pat. No. 7,621,772.

(51) Int. Cl.
*H01R 13/58* (2006.01)

(52) U.S. Cl. ..... 439/460

(58) Field of Classification Search ..... 439/450, 439/459, 460, 470, 461–465, 676; 174/660
See application file for complete search history.

(56) References Cited

U.S. PATENT DOCUMENTS

| | | | | |
|---|---|---|---|---|
| 1,725,883 | A | 8/1929 | Recker | |
| 1,830,250 | A | 11/1931 | Tiefenbacher | |
| 3,523,269 | A * | 8/1970 | Bissland et al. | 439/358 |
| 3,858,151 | A | 12/1974 | Paskert | |
| 4,441,776 | A | 4/1984 | Anhalt | |
| 4,711,507 | A | 12/1987 | Noorily | |
| 4,737,118 | A | 4/1988 | Lockard | |
| 5,445,538 | A | 8/1995 | Rodrigues et al. | |
| 5,732,984 | A | 3/1998 | Bartholomew | |
| 5,743,759 | A | 4/1998 | Pudims et al. | |
| 5,866,853 | A | 2/1999 | Sheehan | |
| 6,010,353 | A * | 1/2000 | Ensz et al. | 439/404 |
| 6,056,586 | A * | 5/2000 | Lin | 439/460 |
| 6,142,828 | A | 11/2000 | Pepe | |
| 6,238,231 | B1 * | 5/2001 | Chapman et al. | 439/404 |
| 6,422,884 | B1 | 7/2002 | Babasick et al. | |
| 6,582,248 | B2 | 6/2003 | Bachman | |
| 6,872,886 | B2 | 3/2005 | Kiely | |
| 6,953,362 | B2 * | 10/2005 | Mossner et al. | 439/395 |
| 7,252,554 | B2 * | 8/2007 | Caveney et al. | 439/676 |
| 7,384,298 | B2 | 6/2008 | Caveney et al. | |
| 7,401,402 | B2 * | 7/2008 | Bresche et al. | 29/842 |

(Continued)

FOREIGN PATENT DOCUMENTS

EP 1 199 514 A2 4/2002

*Primary Examiner*—T C Patel
*Assistant Examiner*—Harshad C Patel

(57) ABSTRACT

An electrical connector includes a housing including a rear end. The housing has a cable bore configured to receive a cable, and the housing has an outer pocket positioned radially outward from, and surrounding portions of, the cable bore. A strain relief element is coupled to the housing. The strain relief element includes an end wall having an opening therein. The strain relief element has a flexible beam extending axially inward from the end wall proximate to the opening that is configured to engage the cable. The strain relief element also has a mounting tab extending axially inward from the end wall that is received in the outer pocket and that engages the housing to secure the strain relief element to the housing.

22 Claims, 12 Drawing Sheets

U.S. PATENT DOCUMENTS

| | | | | |
|---|---|---|---|---|
| 7,404,739 | B2 * | 7/2008 | Sheilds et al. | 439/607.05 |
| 7,432,452 | B2 | 10/2008 | Gardner | |
| 2001/0027043 | A1 | 10/2001 | Shiraki et al. | |
| 2002/0155746 | A1 * | 10/2002 | Simpson | 439/357 |
| 2003/0100215 | A1 | 5/2003 | Bachman | |
| 2005/0202697 | A1 * | 9/2005 | Caveney et al. | 439/77 |
| 2006/0005988 | A1 | 1/2006 | Jorgensen | |
| 2006/0246784 | A1 * | 11/2006 | Aekins et al. | 439/676 |
| 2007/0141908 | A1 | 6/2007 | Bert et al. | |
| 2007/0240902 | A1 * | 10/2007 | Tapper | 174/660 |
| 2007/0254525 | A1 | 11/2007 | Pyron et al. | |
| 2007/0278006 | A1 | 12/2007 | Gardner | |

* cited by examiner

ELECTRICAL CONNECTOR WITH A COMPLIANT CABLE STRAIN RELIEF ELEMENT

CROSS REFERENCE TO RELATED APPLICATIONS

This application is a continuation-in-part application of and claims the benefit of U.S. patent application Ser. No. 12/143,291 filed Jun. 20, 2008, the subject matter of which is herein incorporated by reference in its entirety.

BACKGROUND OF THE INVENTION

The subject matter herein relates generally to electrical connectors, and more particularly to electrical connectors having compliant cable strain relief elements.

Various electronic systems, such as those used to transmit signals in the telecommunications industry, include connector assemblies with electrical wires arranged in differential pairs. One wire in the differential pair carries a positive signal and the other wire carries a negative signal intended to have the same absolute magnitude, but at an opposite polarity.

An RJ-45 electrical connector is one example of a connector used to transmit electrical signals in differential pairs. The electrical connector may either be a plug or an outlet jack that is terminated to the end of a cable having individual wires. Typically, the electrical connector includes a cable strain relief to relieve stress on the wires terminated within the electrical connector. The cable strain relief is typically an overmolded portion at the interface of the cable and the electrical connector. The additional step of providing the overmolded strain relief can add cost to the overall connector in terms of both time and material.

In an attempt to avoid that added cost and complexity of overmolding the strain relief; at least some known connector assemblies include an end wall having an opening through which the cable passes. The opening serves as a bend limiting feature that resists bending of the cable. However, such designs provide little strain relief. Additionally, to be effective, the size of the opening needs to be closely matched to the diameter of the cable to provide adequate bend limiting. As such, many different components with different sized openings need to be provided to accomodate a range of cable sizes.

A need remains for an electrical connector that may provide cable strain relief in a cost effective and reliable manner. A need remains for a cable strain relief that may accommodate cables having different diameters. A need remains for a cable strain relief that maintains a nominal force on the cable to hold the cable in position with respect to the electrical connector.

BRIEF DESCRIPTION OF THE INVENTION

In one embodiment, an electrical connector is provided that includes a housing including a rear end. The housing has a cable bore configured to receive a cable, and the housing has an outer pocket positioned radially outward from, and surrounding portions of, the cable bore. A strain relief element is coupled to the rear end of the housing. The strain relief element includes an end wall having an opening therein. The strain relief element has a flexible beam extending axially inward from the end wall proximate to the opening that is configured to engage the cable. The strain relief element also has a mounting tab extending axially inward from the end wall that is received in the outer pocket and that engages the housing to secure the strain relief element to the housing.

In another embodiment, an electrical connector is provided having a strain relief assembly including a housing and a strain relief element coupled to the housing. The strain relief element includes an end wall having an opening and a flexible beam extending from the end wall for engaging a cable received in the opening. The strain relief element has a mounting tab extending from the end wall. The mounting tab has a latch engaging the housing. The mounting tab is separate from the flexible beam such that a channel is created between the mounting tab and the flexible beam. The strain relief element is coupled to the housing such that a portion of the housing is received within the channel between the flexible beam and the mounting tab.

in a further embodiment, an electrical connector is provided that includes a jack housing having a mating end and a wire terminating end and a contact sub-assembly received in the jack housing. The contact subassembly has a plurality of jack contacts that are configured to engage mating contacts of a mating plug. A wire termination subassembly is also received in the jack housing. The wire termination sub-assembly has a plurality of contacts that are configured to be electrically coupled to the jack contacts and to wires of a cable. A strain relief assembly is coupled to the jack housing. The strain relief assembly has a back housing and a strain relief element coupled to the back housing. The strain relief element includes an end wall having an opening and a flexible beam extending from the end wall for engaging the cable received in the opening. The back housing has a wire organizer including a plurality of slots configured to receive and hold individual wires of the cable. The back housing is coupled to the wire terminating end of the jack housing such that the contacts of the wire termination sub-assembly engage the wires held by the wire organizer when the back housing is coupled to the jack housing.

DETAILED DESCRIPTION OF THE INVENTION

Figure 1:
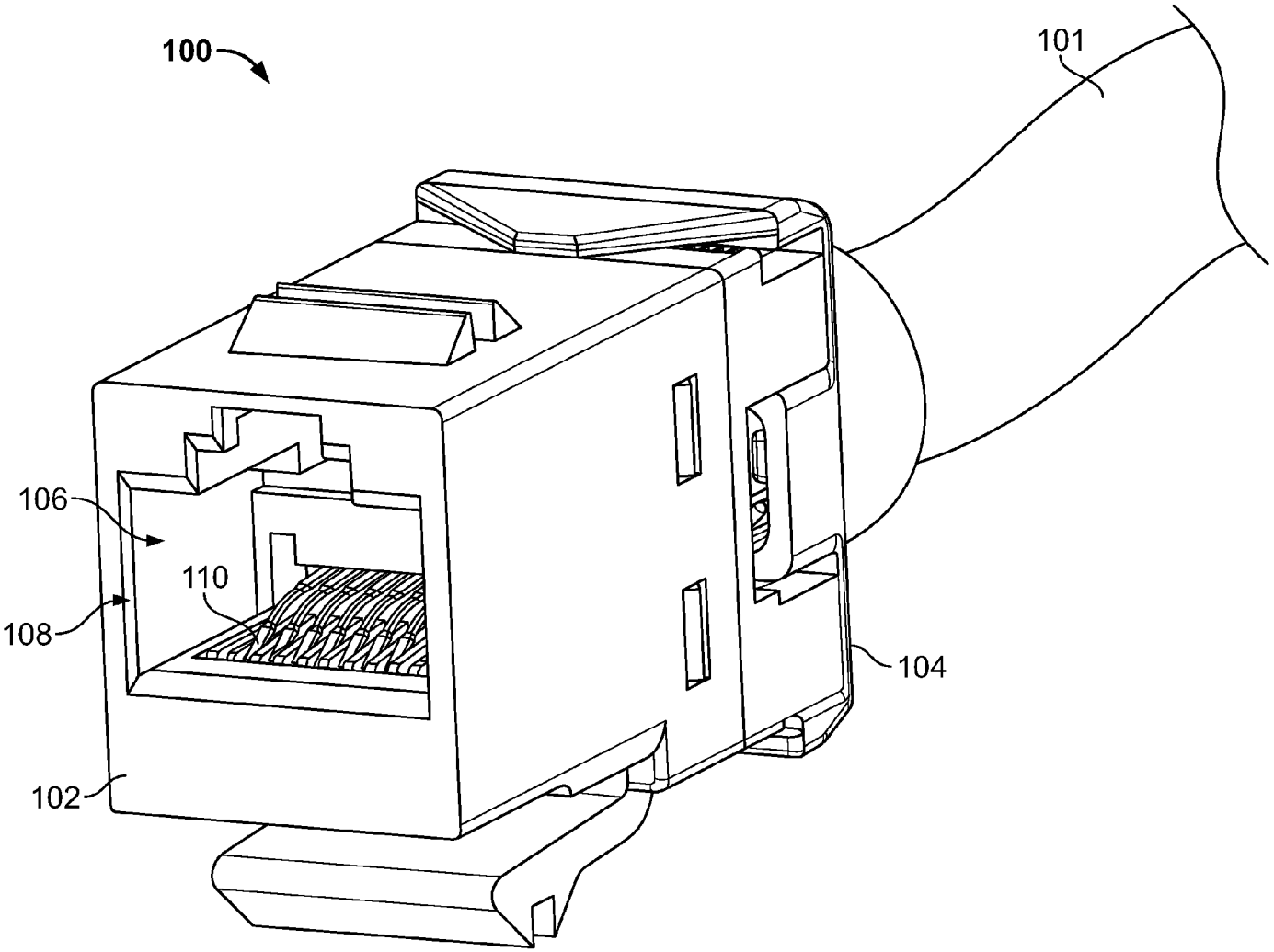
FIG. 1 is a front perspective view of an electrical connector formed in accordance with an exemplary embodiment.

FIG. 1 is a front perspective view of an electrical connector 100 formed in accordance with an exemplary embodiment. The electrical connector 100 is illustrated as an RJ-45 jack or receptacle, however the subject matter described herein may be used with other types of electrical connectors. The RJ-45 jack is thus merely illustrative. The electrical connector 100 is provided at the end of a cable 101. In an exemplary embodiment, the cable 101 includes multiple wires, arranged in differential pairs, such as in a twisted wire pair configuration.

The electrical connector 100 has a front or mating end 102 and a wire termination end 104. A mating cavity 106 is provided at the mating end 102 and is configured to receive a mating connector (not shown) therein. A mating end opening 108 is also provided at the mating end 102 that provides access to the mating cavity 106. Jack contacts 110 are arranged within the mating cavity 106 in an array for mating engagement with mating contacts (not shown) of the mating connector. In the example of FIG. 1, the mating cavity 106 accepts an RJ-45 plug (not shown) inserted through the mating end opening 108. The RJ-45 plug has mating contacts which electrically interface with the array of jack contacts 110.

Figure 2:
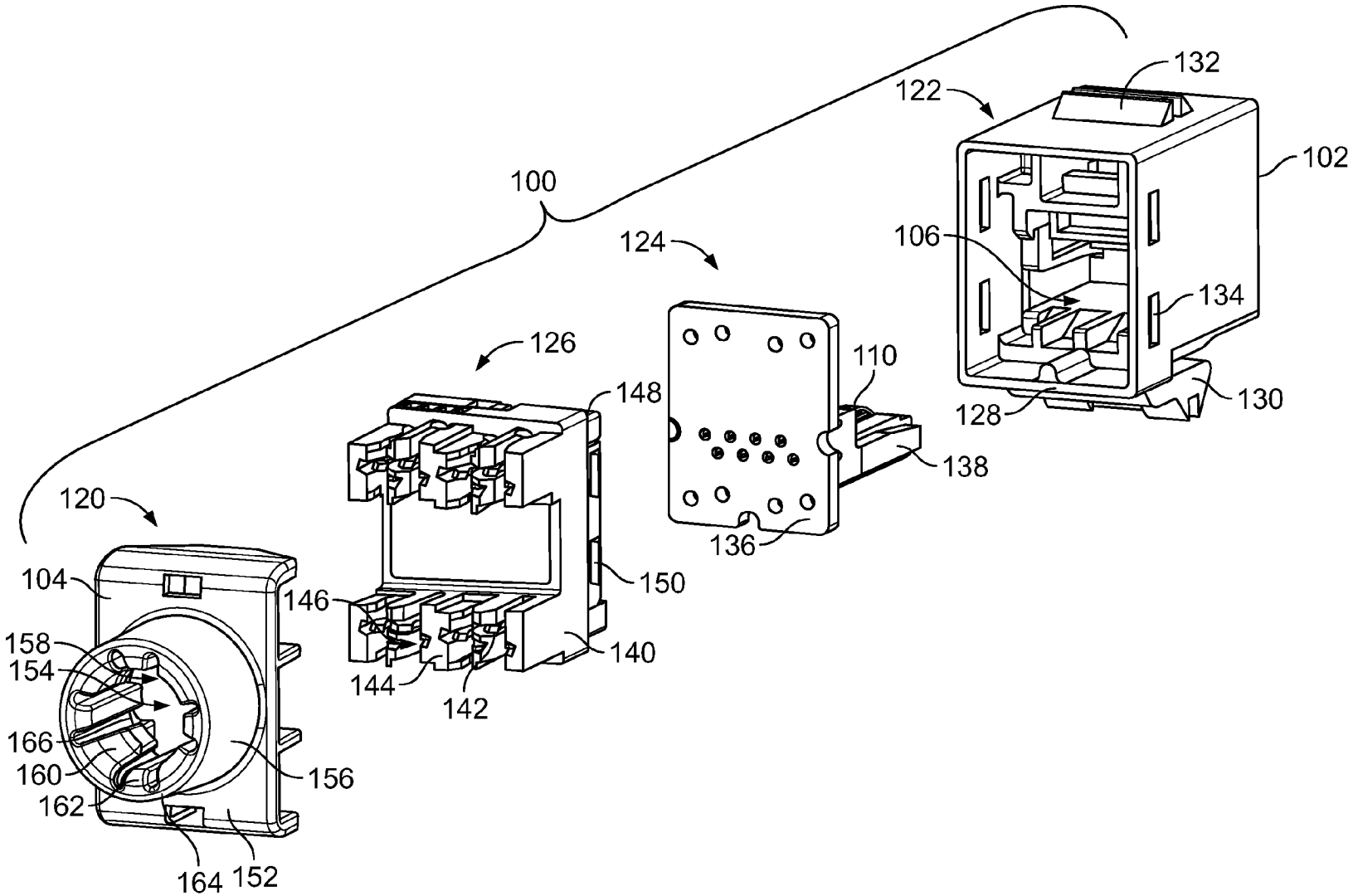
FIG. 2 is an exploded view of the electrical connector shown in FIG. 1 illustrating a cable strain relief element.

FIG. 2 is an exploded view of the electrical connector 100 illustrating a cable strain relief element 120. The electrical connector 100 includes a jack housing 122, a contact sub-assembly 124 and a wire termination sub-assembly 126. The contact sub-assembly 124 is loaded into the jack housing 122 and the wire termination sub-assembly 126 is coupled to the jack housing 122.

The jack housing 122 is generally box-shaped, however the jack housing 122 may have any shape depending on the particular application. The jack housing 122 extends between the front end 102 and a rear end 128. The mating cavity 106 extends at least partially between the front and rear ends 102, 128. The jack housing 122 is fabricated from a dielectric material, such as a plastic material. Alternatively, the jack housing 122 may be shielded, such as by being fabricated by a metal material or a metalized plastic material, or by having a shield element. In one embodiment, the jack housing 122 includes latches 130, 132 for mounting to a wall panel. The jack housing 122 also includes slots 134 in side walls of the jack housing 122.

The contact subassembly 124 includes a substrate 136, such as a circuit board, and a tray 138 extending from one side of the substrate 136. The jack contacts 110 are mounted to the substrate 136 and are supported by the tray 138. Optionally, the jack contacts 110 may include pins that are through-hole mounted to the substrate 136. Alternatively, the jack contacts 110 may be soldered to the substrate 136 or the jack contacts 110 may be supported by the substrate 136 for direct mating with the wires of the cables or with other contacts. The contact sub-assembly 124 is received in the jack housing 122 such that the jack contacts 110 are presented at the mating cavity 106.

The wire termination sub-assembly 126 includes a wire termination housing 140 that holds a plurality of wire termination contacts 142 in respective contact towers 144. The contact towers 144 extend from a rear end of the housing 140 and include slots 146 that receive the wires of the cable 101 (shown in FIG. 1). The contacts 142 are illustrated as being insulation displacement contacts, however any type of contacts may be provided for terminating to the individual wires of the cable 101. The contacts 142 are configured to be electrically and mechanically coupled to the substrate 136 of the contact sub-assembly 124 when the electrical connector 100 is assembled. For example, the contacts 142 may include pins that project from a mating end 148 of the housing 140 and that are received in through-holes in the substrate 136. Optionally, traces routed along the substrate 136 may connect the contacts 142 with the jack contacts 110. The contacts 142 may be press-fit or soldered to the through-holes in the substrate 136. When assembled, the wire termination sub-assembly 126 is coupled to the rear end 128 of the jack housing 122. In an exemplary embodiment, the housing 140 includes tabs 150 on the sides of the housing 140 that are received in the slots 134 in the jack housing 122 to secure the wire termination sub-assembly 126 to the jack housing 122.

The strain relief element 120 is coupled to the housing 140 and is configured to hold the cable 101 (shown in FIG. 1) and/or the associated wires of the cable 101. The strain relief element 120 includes an end wall 152 that defines the wire termination end 104 of the electrical connector 100. When the electrical connector 100 is assembled, the strain relief element 120 defines an end cap at the wire termination end 104. The strain relief element 120 also includes an opening 154 extending therethrough that is configured to receive the cable 101. The opening 154 extends transversely through the end wall 152.

In an exemplary embodiment, the strain relief element 120 includes a boss 156 extending rearward from the end wall 152. The boss 156 defines a channel 158 extending therethrough. A plurality of flexible beams 160 and a plurality of ribs 162 extend axially along, and inward into, the channel 158 from the boss 156. FIG. 2 illustrates tour flexible beams 160 and four ribs 162 positioned between adjacent ones of the flexible beams 160. Other embodiments, may have any number of flexible beams 160 and ribs 162, including just a single beam 160 and/or a single rib 162. Optionally, the strain relief element 120 may not include any beams 160. In an exemplary embodiment, the channel 158 extends between a distal end 164 and a proximal end 166 that is substantially aligned with the end wall 152. The distal end 164 is provided a distance from the proximal end 166 and/or the end wall 152. The opening 154 is defined at the distal end 164 of the boss 156. The flexible beams 160 and ribs 162 extend at least partially between the distal end 164 and the proximal end 166. In an exemplary embodiment, the flexible beams 160 and ribs 162 extend from the distal end 164 to the proximal end 166. The flexible beams 160 and the ribs 162 cooperate to engage and/or hold the cable 101 within the strain relief element 120. The flexible beams 160 and the ribs 162 may reduce stresses on the wires due to bending or other movement of the cable 101.

Figure 3:
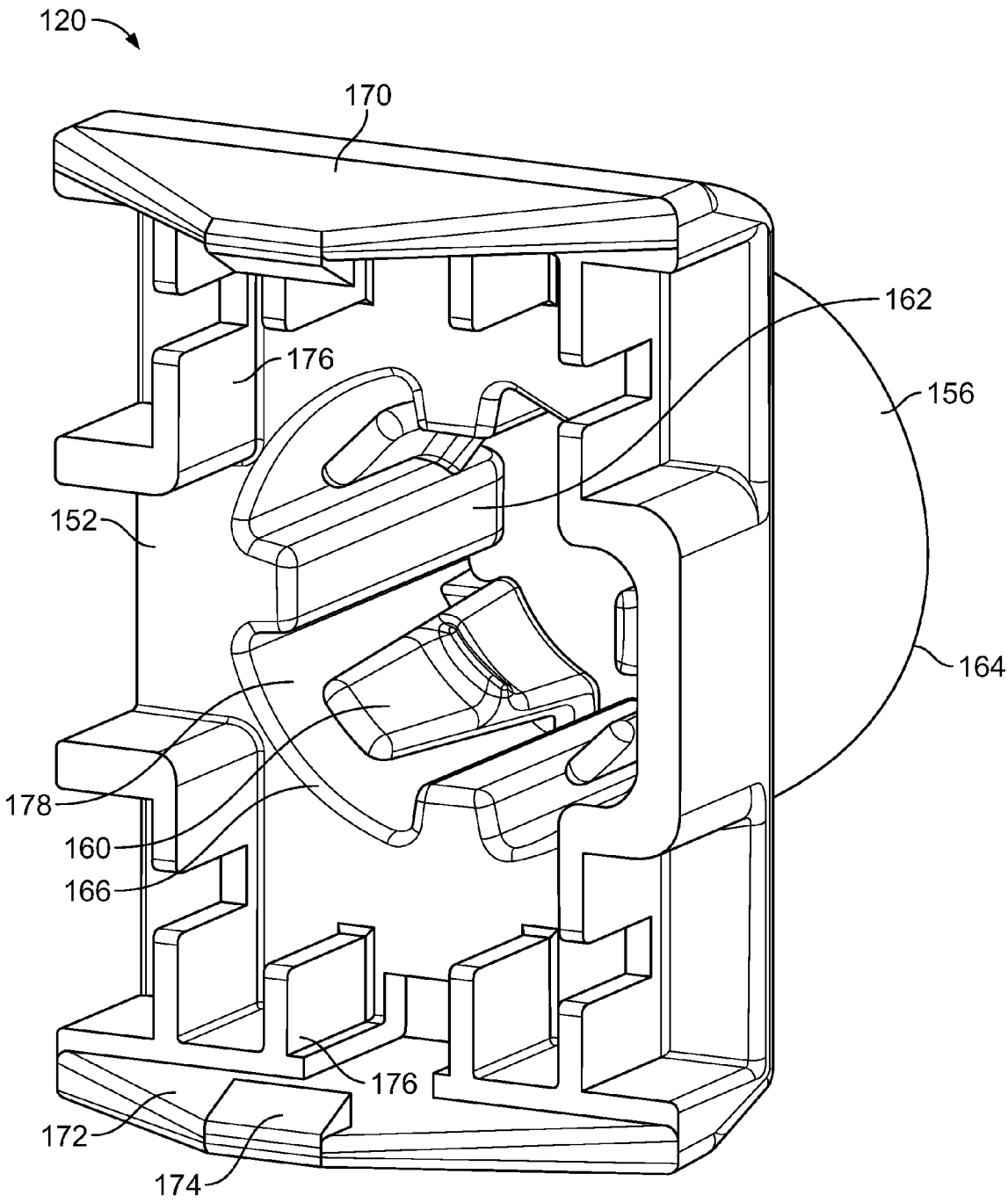
FIG. 3 is a perspective view of the strain relief element shown in FIG. 2.

FIG. 3 is a perspective view of the interior side of the strain relief element 120. The strain relief element 120 includes the end wall 152 and top and bottom walls 170, 172. Tabs 174 are provided on the top and bottom walls 170, 172 for mounting to the housing 140 (shown in FIG. 2). A plurality of inner walls 176 are provided on the interior side of the strain relief element 120. Optionally, the inner walls 176 may be sized, shaped and positioned to complement the housing 140 of the wire termination sub-assembly 126 (shown in FIG. 2), such as by fitting between and/or around the contact towers 144 (shown in FIG. 2). Optionally, the inner walls 176 may be used to organize and/or position the wires of the cable 101 (shown in FIG. 1) during assembly of the strain relief element 120 with the housing 140. For example, the wires may be laced around and/or through the inner walls 176 such that the wires are properly positioned for mating with the contacts 142 during assembly of the strain relief element 120 with the housing 140.

The ribs 162 are illustrated in FIG. 3 as extending along the boss 156 to the end of the channel 158. The ribs 162 extend axially along the boss 156. In an exemplary embodiment, rails 178 are provided between the ribs 162. The rails 178 define a radially inner surface of the boss 156 and radially outer surface of the channel 158. The rails 178 are defined by the boss 156. The rails 178 extend from the distal end 164 to the proximal end 166 and are positioned radially outward from the flexible beams 160. In other words, the flexible beams 160 are aligned with, and positioned radially inward with respect to, the rails 178.

Figure 4:
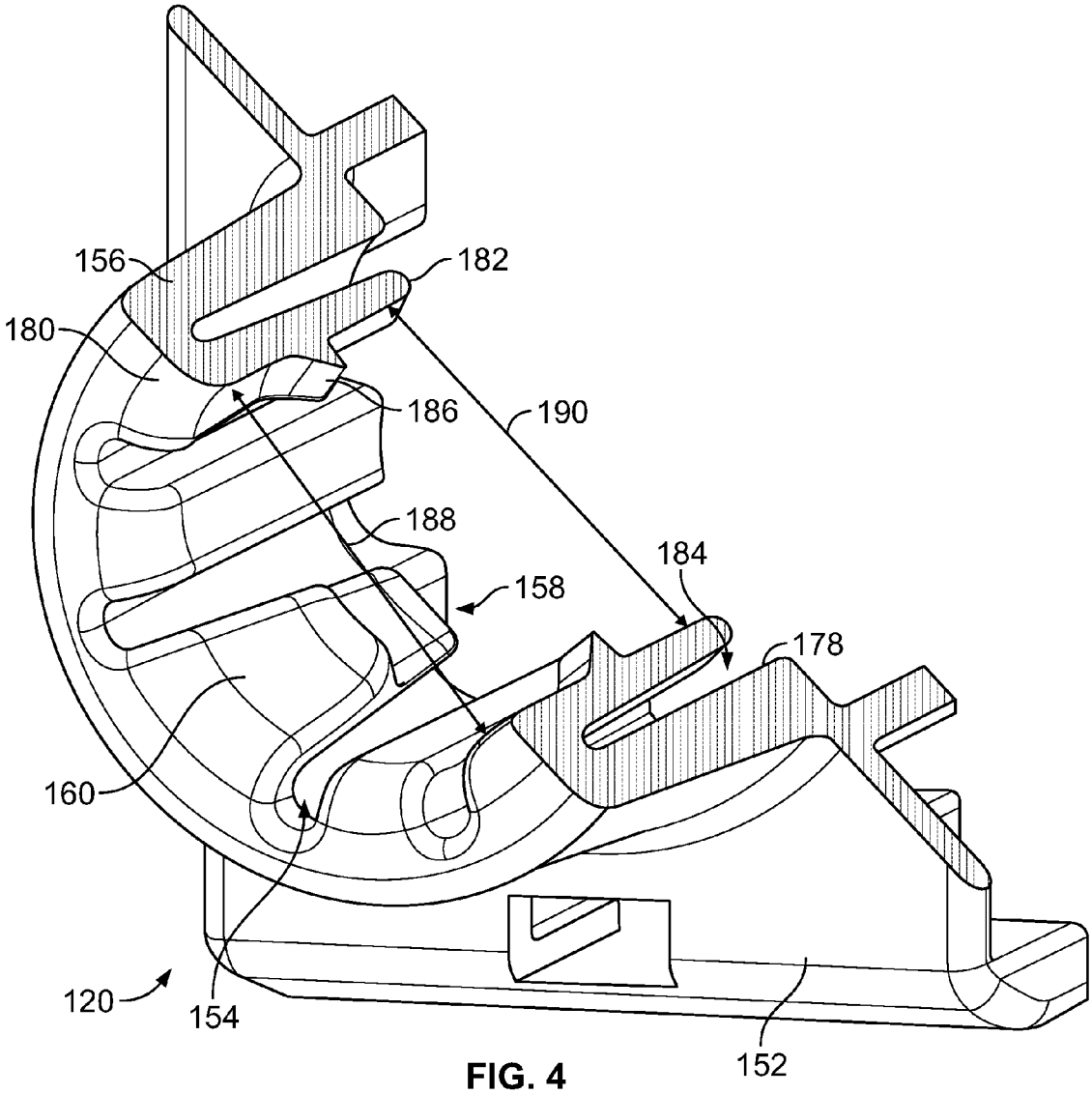
FIG. 4 is a perspective cross-sectional view of the strain relief element showing a plurality of flexible beams.

FIG. 4 is a cross-sectional view of the strain relief element 120 showing a plurality of flexible beams 160. The flexible beams 160 extend between fixed ends 180 and free ends 182. The flexible beams 160 thus define cantilevered beams that are attached to the boss 156 at the fixed ends 180. In the illustrated embodiment, the flexible beams. 160 are fixed proximate the opening 154 and the free ends 182 are substantially aligned with the end wall 152. The free ends 182 are generally elevated above the corresponding rails 178 such that a flex space 184 is determined between the flexible beams 160 and the rails 178. When the cable 101 (shown in FIG. 1) is loaded through the opening 154, the flexible beams 160 are flexed outward and engage the cable 101 to hold the cable 101 between the flexible beams 160. The flexing of the flexible beams 160 provides a normal force on the cable 101 in a generally radially inward direction.

In an exemplary embodiment, retention features 186 extend radially inward from the flexible beams 160. The retention features 186 are configured to engage the cable 101 when the cable 101 is loaded into the strain relief element 120. In one embodiment, the retention features 186 are positioned generally centrally along the beams 160, however, the location may be strategically selected to any location along the beam 160. For example, the location of the retention feature 186 may control an amount of normal force on the cable 101 or the location of the retention feature 186 may control an amount of deflection or a rate of deflection of the beam 160. The size and/or shape of the retention feature 186 may control an amount of deflection or a rate of deflection of the beam 160.

Optionally, the flexible beams 160 may be integrally formed with the boss 156 and/or the strain relief element 120. For example, the strain relief element 120 may be a molded plastic material. In some embodiments, the strain relief element 120 may be coated or plated or otherwise fabricated from a conductive material to provide shielding and the flexible beams 160 may engage a shield or cable braid of the cable 101 to provide a ground path between the cable 101 and the strain relief element 120.

In an exemplary embodiment, an even number of flexible beams 160 are provided and the flexible beams 160 are circumferentially spaced apart from one another around the channel 158. Each flexible beam 160 may have a complimentary flexible beam 160 directly opposite therefrom that together define a beam set (e.g. the flexible beams 160 shown in cross-section in FIG. 4). The flexible beams 160 of the beam set provide opposite normal forces on the cable 101. The flexible beams 160 of a beam set are separated from one another by a fixed end distance 188 between the fixed ends 180. The flexible beams 160 of a beam set are separated from one another by a free end distance 190 between the free ends 182. The distances 188, 190 may be the same as one another or may be different from one another. The fixed end distance 188 is fixed and does not change upon loading or movement of the cable 101. The free end distance 190 is changeable as the cable 101 is loaded into the channel 158 by flexing the flexible beams 160 outward.

Figure 5:
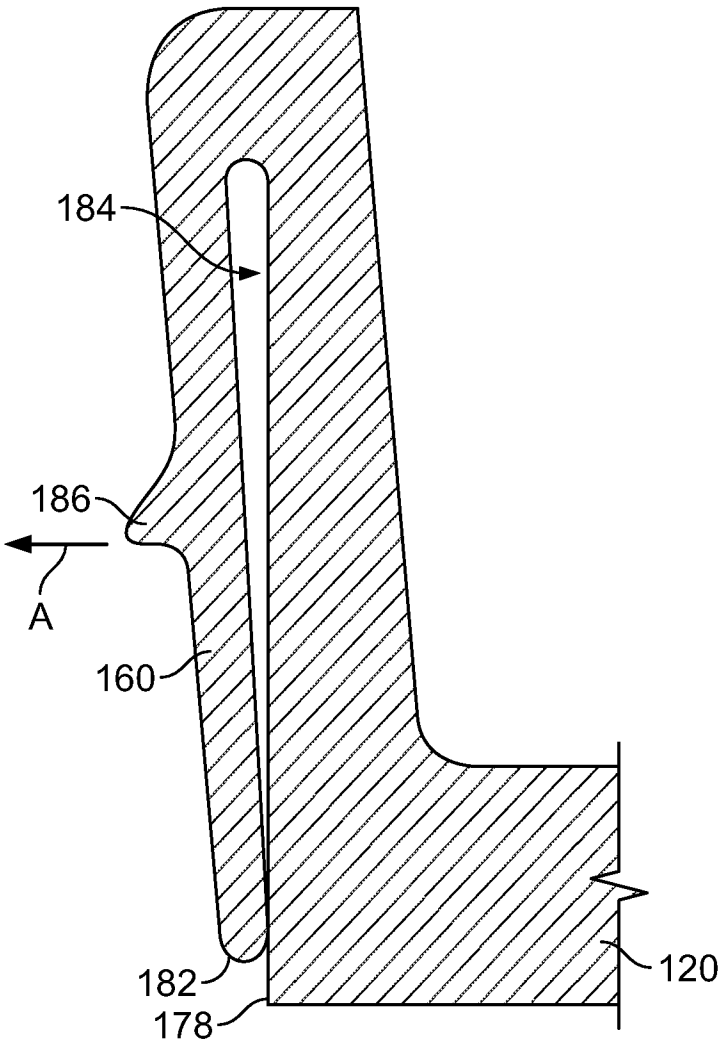
FIG. 5 is a cross-sectional view of the strain relief element illustrating the flexible beam in an un-deflected and a deflected state.
Figure 5:
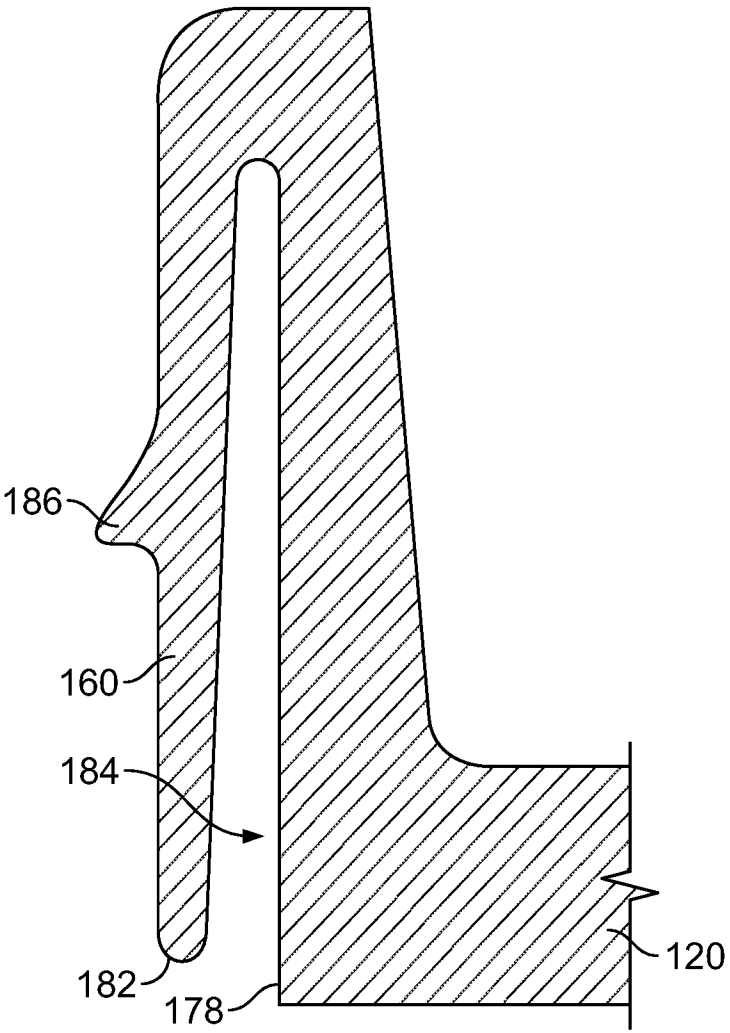

FIG. 5 is a cross-sectional partial view of the strain relief element 120 illustrating the flexible beam 160 in an un-deflected state (e.g. the left view in FIG. 5) and a deflected state (e.g. the right view in FIG. 5). The flexible beam 160 may be transferred to the deflected state when the cable 101 (shown in FIG. 1) is loaded into the strain relief element 120. As the cable 101 engages the flexible beam 160 and/or the retention feature 186, the free end 182 of the flexible beam 160 is pushed generally toward the rail 178. The diameter of the cable 101 is one factor that determines how much the flexible beam 160 deflects. As the flexible beam 160 is deflected, the beam 160 begins to fill the flex space 184. As the beam 160 is deflected, the beam 160 imparts a normal force on the cable 101 in a direction generally away from the beam 160, such as the direction of arrow A illustrated in FIG. 5.

In the deflected state, the flexible beam 160 may engage the rail 178 which defines a flex limit, however, the amount of deflection may be less than the amount needed to engage the rail 178, depending on the size of the cable 101. When the flexible beam 160 engages the rail 178, the beam 160 defines a simply supported beam as opposed to a cantilevered beam. As a simply supported beam, the beam 160 may function differently than a cantilevered beam. For example, the normal force imparted on the cable 101 may be different. For example, for a given amount of deflection at the retention feature 186, the normal force imparted on the cable 101 by the beam 160 as a cantilevered beam is less than the normal force imparted on the cable 101 by the beam 160 as a simply supported beam. After the beam 160 engages the rail 178, further deflection of the beam 160 deflects the beam 160 generally at the center of the beam 160, such as proximate to the retention feature 186.

Figure 6:
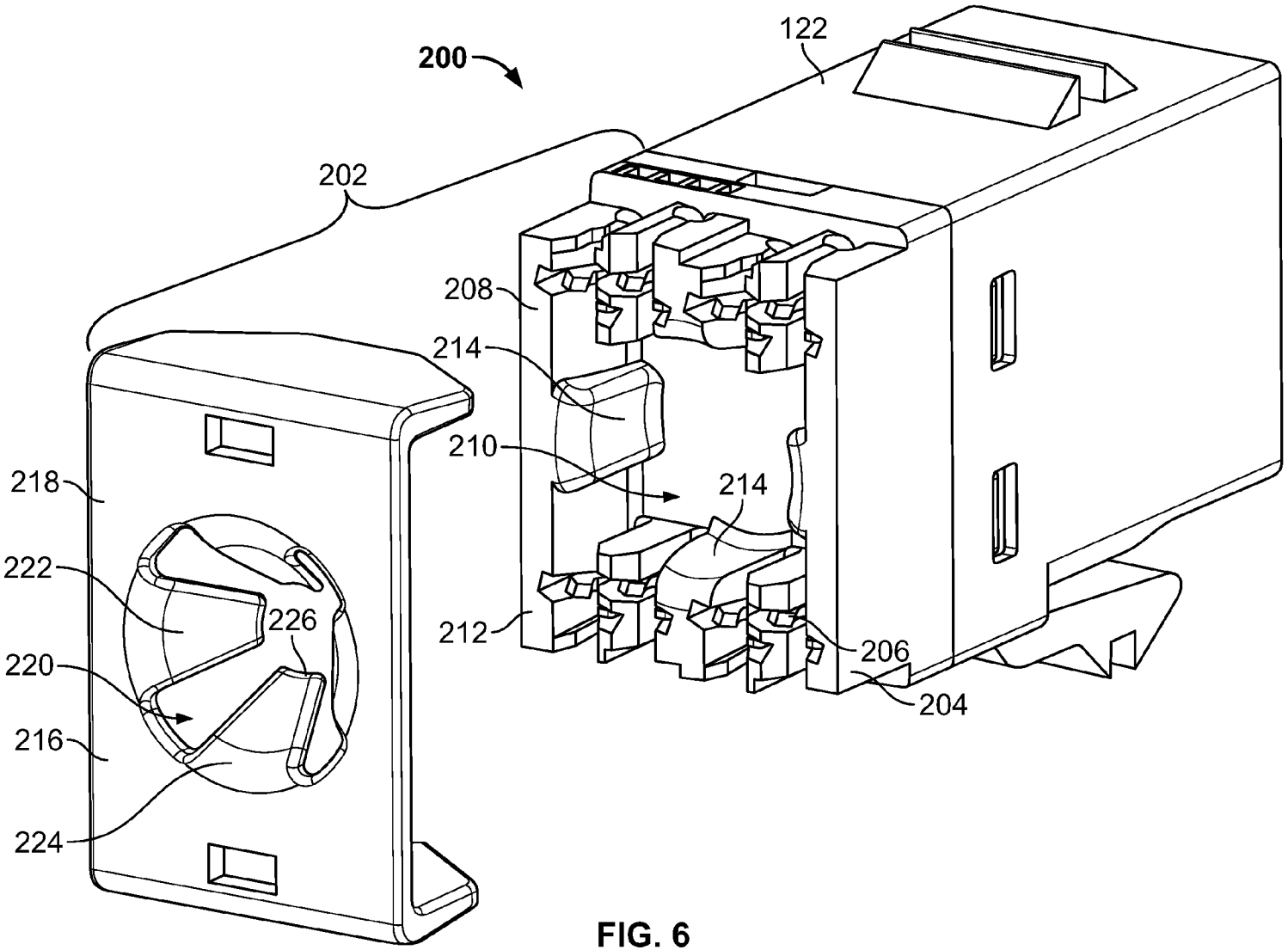
FIG. 6 is a rear exploded perspective view of an alternative electrical connector.

FIG. 6 is a rear perspective exploded view of an alternative electrical connector 200. The electrical connector 200 is similar to the electrical connector 100 in some respects, and like components are identified with like reference numerals. The electrical connector 200 includes a wire termination sub-assembly 202 coupled to the jack housing 122.

The wire termination subassembly 202 includes a housing 204 holding a plurality of contacts 206. The housing 204 includes a plurality of walls 208 defining a chamber 210 extending inward from a wire termination end 212. The walls 208 include a plurality of rails 214 that extend along the walls 208. In the illustrated embodiment, four rails 214 are provided. Optionally, the rails 214 may be curved.

The wire termination sub-assembly 202 also includes a strain relief element 216. The strain relief element 216 includes an end wall 218 and an opening 220 extending therethrough. A plurality of flexible beams 222 extend inward from the end wall 218 at the opening 220. The flexible beams 222 include fixed ends 224 and free ends 226. The beams 222 may be rotated radially outward about the fixed ends 224 when a cable is inserted through the opening 220. The beams 222 impart a normal force on the cable when inserted therethrough. In an exemplary embodiment, when the strain relief element 216 is coupled to the housing 204, the beams 222 are substantially aligned with the rails 214. The beams 222 may be deflected until the free ends 226 engage the rails 214, and in some embodiments may be further deflected even after the free ends 226 engage the rails 214, such as by deflecting the center portion of the beams 222 outward.

Figure 7:
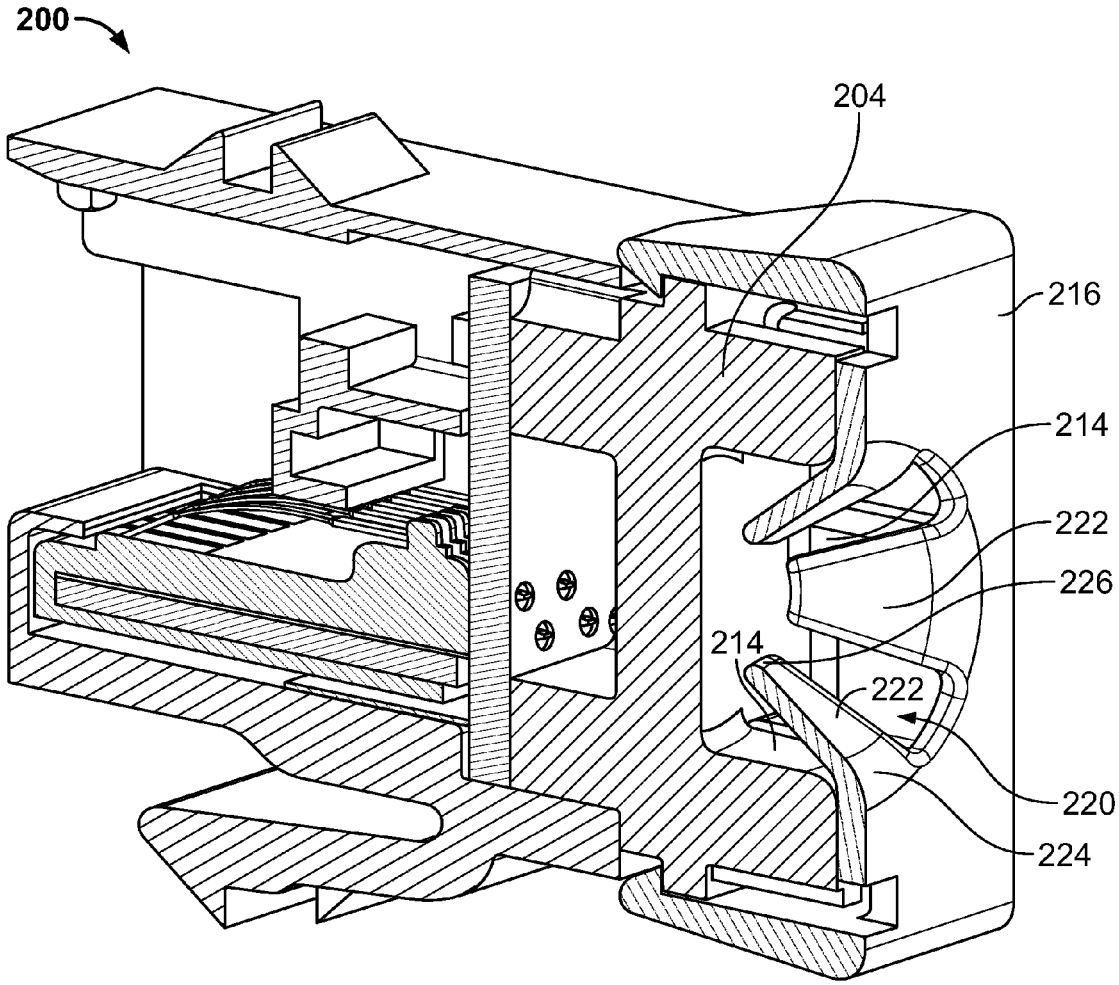
FIG. 7 is a cross-sectional view of the assembled electrical connector shown in FIG. 6.

FIG. 7 is a cross-sectional view of the assembled electrical connector 200. FIG. 7 illustrates the strain relief element 216 coupled to the housing 204. The flexible beams 222 are aligned with the rails 214. In operation, with the cable inserted into the opening 220, the beams 222 are deflected outward toward the rails 214, which define flex limits for the free ends 226 of the beams 222. During assembly, the cable is inserted into the strain relief element 216 prior to coupling the strain relief element 216 to the housing 204.

Figure 8:
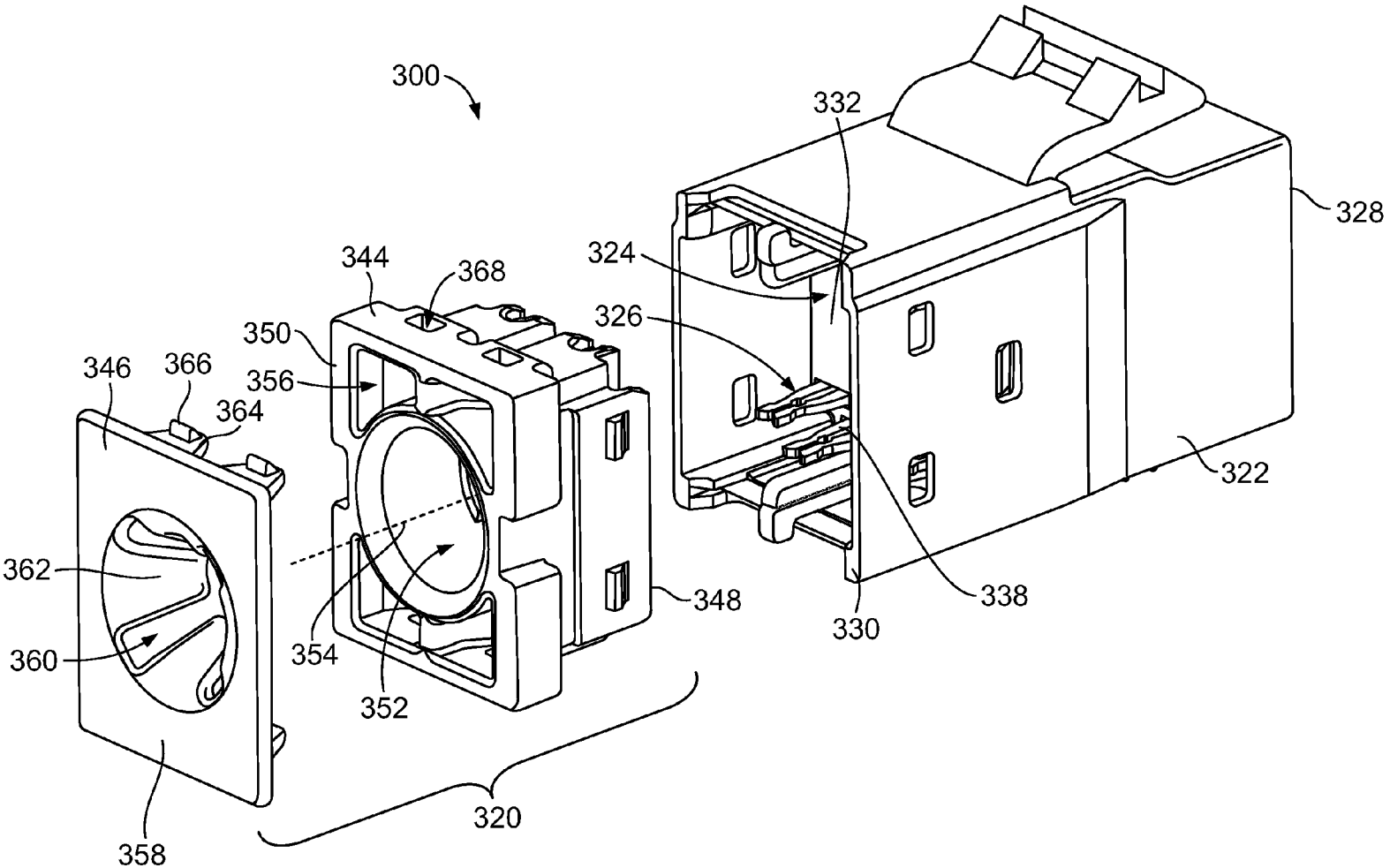
FIG. 8 is an exploded rear perspective view of another alternative electrical connector.

FIG. 8 is an exploded rear perspective view of another alternative electrical connector 300. The electrical connector 300 is similar to the electrical connector 100 (shown in FIG. 2) in some respects. The electrical connector 300 includes a strain relief assembly 320 that is configured to be coupled to a jack housing 322. A contact sub-assembly 324 and a wire termination sub-assembly 326 are arranged within the jack housing 322. The jack housing 322, contact subassembly 324 and wire termination sub-assembly 326 may be similar to the jack housing 122, contact subassembly 124 and wire termination sub-assembly 126 (shown in FIG. 2).

The jack housing 322 extends between a front end 328 and a rear end 330. The contact sub-assembly 324 is arranged within the jack housing 322 between the front and rear ends 328, 330 and includes a substrate 332 that is generally parallel to the front and rear ends 328, 330. Jack contacts (not shown) are mounted to the substrate 332. The wire termination sub-assembly 326 includes a plurality of wire termination contacts 338 that extend rearward from the substrate 332. The contacts 338 are illustrated as being insulation displacement contacts, however any type of contacts may be provided for terminating to individual wires 340 of a cable 342 (shown in FIG. 9). The contacts 338 are configured to be electrically and mechanically coupled to the substrate 332 of the contact sub-assembly 324 when the electrical connector 300 is assembled. The substrate 332 may connect the contacts 338 with the jack contacts.

The strain relief assembly 320 includes a back housing 344 and a strain relief element 346 that is coupled to the back housing 344. When the electrical connector 300 is assembled, the strain relief assembly 320 defines an end cap at the rear end 330 of the jack housing 322. The strain relief assembly 320 is configured to hold the cable 342 and/or the associated wires 340 of the cable 342. The back housing 344 includes a dielectric body having a front end 348 and a rear end 350. A cable bore 352 extends axially between the front and rear ends 348, 350 along a bore axis 354. The cable bore 352 is configured to receive the cable 342 in a loading direction along the bore axis 354. The cable bore 352 may be cylindrical in shape, or alternatively may have any other shape.

The back housing 344 includes outer pockets 356 positioned radially outward from, and surrounding portions of, the cable bore 352. In the illustrated embodiment, the outer pockets 356 are positioned both above and below the cable bore 352. The outer pockets 356 may be positioned elsewhere. The outer pockets 356 may entirely circumferentially surround the cable bore 352, or alternatively, may only surround select portions of the cable bore 352 such as in the illustrated embodiment. Optionally, only a single outer pocket 356 may be provided extending any circumferential distance around the cable bore 352. The outer pockets 356 are configured to receive a portion of the strain relief element 346, and may have any shape to accommodate such portion of the strain relief element 346. Optionally, the outer pocket 356 may be open along the radially outer portion of the outer pockets 356, such that no portion of the back housing 344 is positioned outward of the outer pockets 356. The outer pockets 356 may be defined outward of the outer perimeter of the back housing 344 and/or the jack housing 322. Such an embodiment is similar to the embodiment illustrated in FIG. 7.

The strain relief element 346 includes an end wall 358 that defines the rear end 330 of the electrical connector 300. The strain relief element 346 also includes an opening 360 extending therethrough that is configured to receive the cable 342. The opening 360 extends through the end wall 358 and is aligned with the cable bore 352 along the bore axis 354. A plurality of flexible beams 362 and a plurality of mounting tabs 364 extend axially inward from the end wall 358. The mounting tabs 364 have latches 366 that engage the back housing 344 to secure the strain relief element 346 to the back housing 344. For example, the back housing 344 may include latches 368 that engage and interact with the latches 366 to secure the components together. One of the latches 366, 368 may define a window and the other of the latches 366, 368 may define a protrusion that is configured to be received in the window. In an exemplary embodiment, the mounting tabs 364 are received within the outer pockets 356. The flexible beams 362 are received within the cable bore 352. The mounting tabs 364 are separate and distinct from the flexible beams 362. The mounting tabs 364 extend from different portions of the end wall 358 are connected together by the end wall 358, as opposed to being directly connected one another or part of the same structure.

FIG. 8 illustrates four flexible beams 362 and four mounting tabs 364 positioned radially outward of the flexible beams 362 from the end wall 358 proximate to the top and bottom of the end wall 358. Other embodiments, may have any number of flexible beams 362 and/or mounting tabs 364, including just a single beam 362 and/or a single mounting tab 364.

It is realized that the strain relief element 346 and back housing 344 may be a single piece as opposed to two pieces. For example, the features of the strain relief element 346 and the back housing 344 may be formed together, such as during a molding operation. Such a configuration would have the flexible beams 362 extending into the cable bore 352, with the beams 362 being formed integral with the body of the back housing 344.

Optionally, portions of the strain relief element 346 and/or portions of the back housing 344 may be made from a metal material or from metalized plastic. For example, such may be the case with a shielded connector. The strain relief element may engage a shield or metal braid of the cable when a shielded cable is loaded into the strain relief element 346. The strain relief assembly 320 may thus provide shielding or form part of a shielded electrical connector. The strain relief assembly 320 may provide electrical bonding between the cable and the electrical connector 300 to complete a grounding path of the shielded system.

Figure 9:
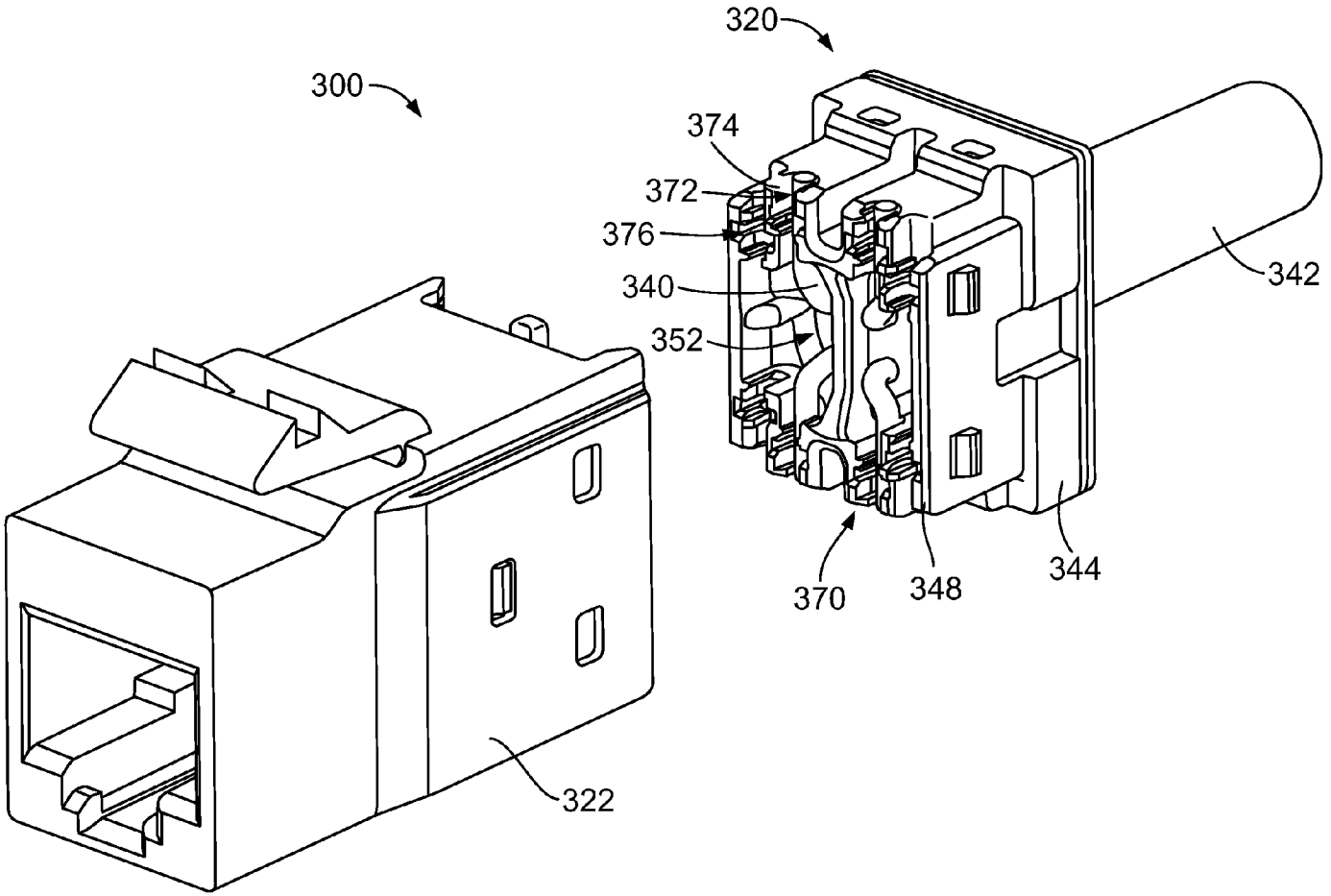
FIG. 9 is an exploded front perspective view of the electrical connector shown in FIG. 8 with a cable attached to a cable strain relief assembly of the electrical connector.

FIG. 9 is an exploded front perspective view of the electrical connector 300 with the cable 342 attached to the strain relief assembly 320 of the electrical connector 300. The cable 342 is loaded into the cable bore 352 and the wires 340 extend from the cable 342 to the front end 348 of the back housing 344. The front end 348 of the back housing 344 includes a wire organizer 370.

The wire organizer 370 is used for lacing the individual wires 340 to position and hold the wires 340 for assembly with the wire termination sub-assembly 326 (shown in FIG. 8). The wire organizer 370 includes a plurality of slots 372 that receive the individual wires 340. The slots have clips 374 that hold the wires 340. The slots 372 have contact channels 376 that receive portions of the contacts 338 (shown in FIG. 8) of the wire termination sub-assembly 326. During assembly, the strain relief assembly 320 is coupled to the jack housing 322. As the strain relief assembly 320 is loaded into the jack housing 322, the contacts 338 are received in the contact channels 376 and engage corresponding wires 340, making electrical contact with the wires 340.

Figure 10:
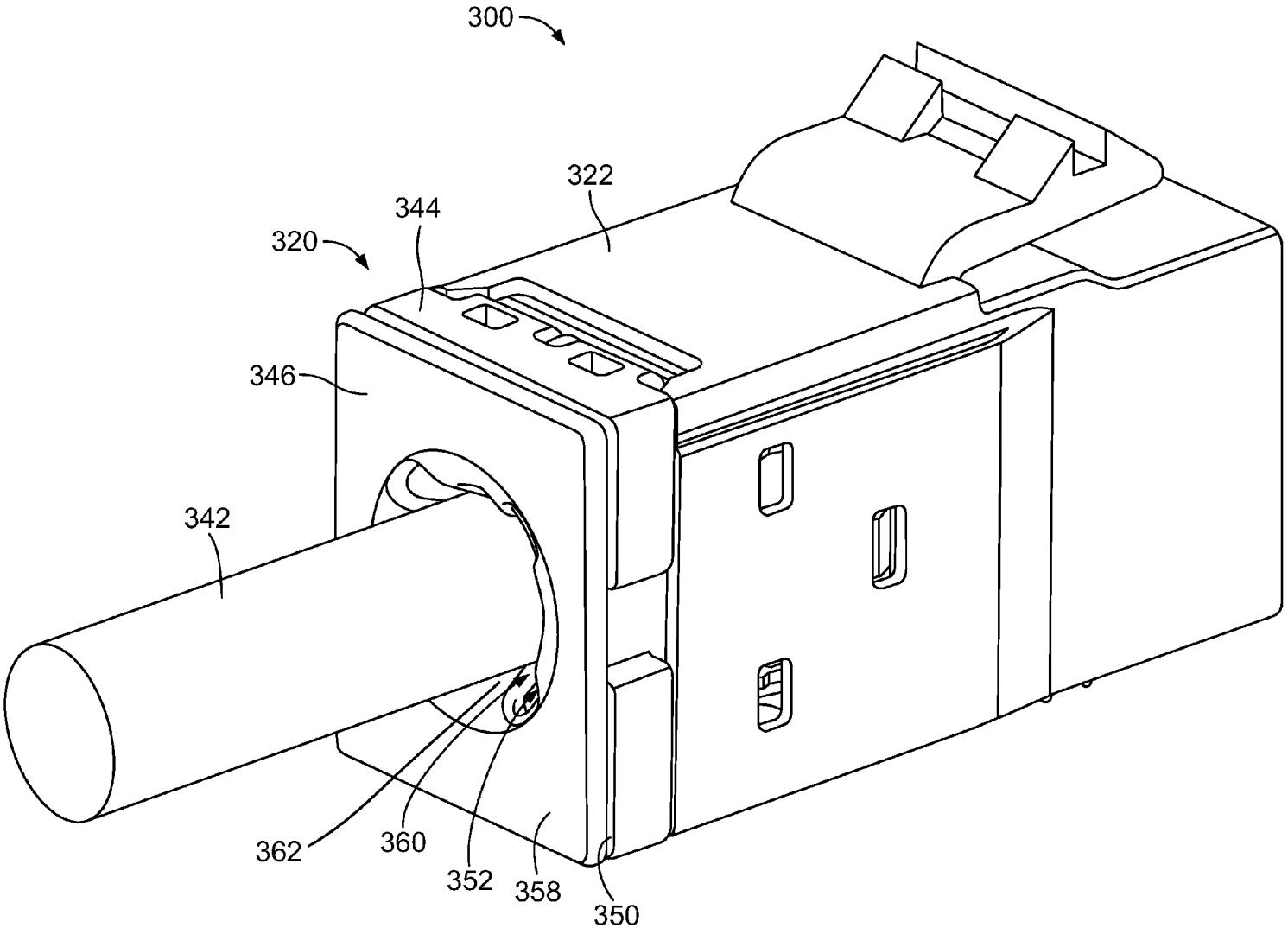
FIG. 10 is an assembled rear perspective view of the electrical connector shown in FIG. 8 with the cable attached to a cable strain relief assembly.

FIG. 10 is an assembled rear perspective view of the electrical connector 300 with the cable 342 attached to the strain relief assembly 320 of the electrical connector 300. The strain relief element 346 is coupled to the back housing 344, and the back housing 344 is coupled to the jack housing 322. The cable 342 enters the electrical connector 300 through the opening 360 in the strain relief element 346 and is received in the cable bore 352. The beams 362 hold the cable 342 within the electrical connector 300 and provide strain relief. In an exemplary embodiment, the cable 342 is loaded through the opening 360 into the cable bore 352 prior to the strain relief assembly 320 being coupled to the jack housing 322.

The back housing 344 defines an outer perimeter at the rear end 350. Optionally, the outer perimeter may be substantially the same as the outer perimeter of the jack housing 322 so that the back housing 344 does not extend radially outward from the jack housing 322, thus maintaining the relative size (cross-section or width and height) of the electrical connector 300. The back housing 344 does extend axially rearward from the jack housing 322, thus increasing the overall length of the electrical connector 300. The end wall 358 of the strain relief element 346 has an outer perimeter that is substantially the same as the outer perimeter of the rear end 350. For example, the outer perimeter of the end wall 358 is flush with the outer perimeter of the back housing 344. The end wall 358 does not extend radially outward from the back housing 344, thus maintaining the relative size (cross-section or width and height) of the electrical connector 360. The strain relief element 346 is coupled to the back housing 344 such that the end wall 358 is rearward of the rear end 350. As such, the end wall 358 does extend axially rearward from the back housing 344, thus increasing the overall length of the electrical connector 300.

Figure 12:
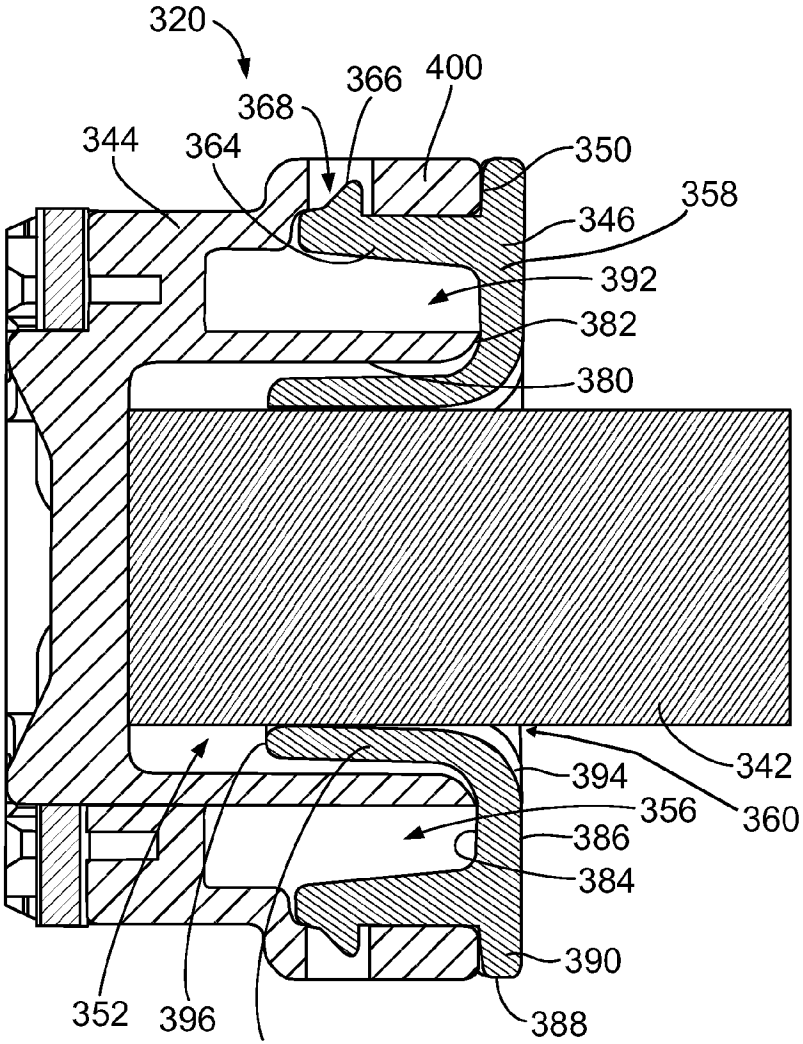
FIG. 12 is a cross-sectional view of the strain relief assembly shown in FIG. 9 with the cable held by the strain relief assembly.
Figure 11:
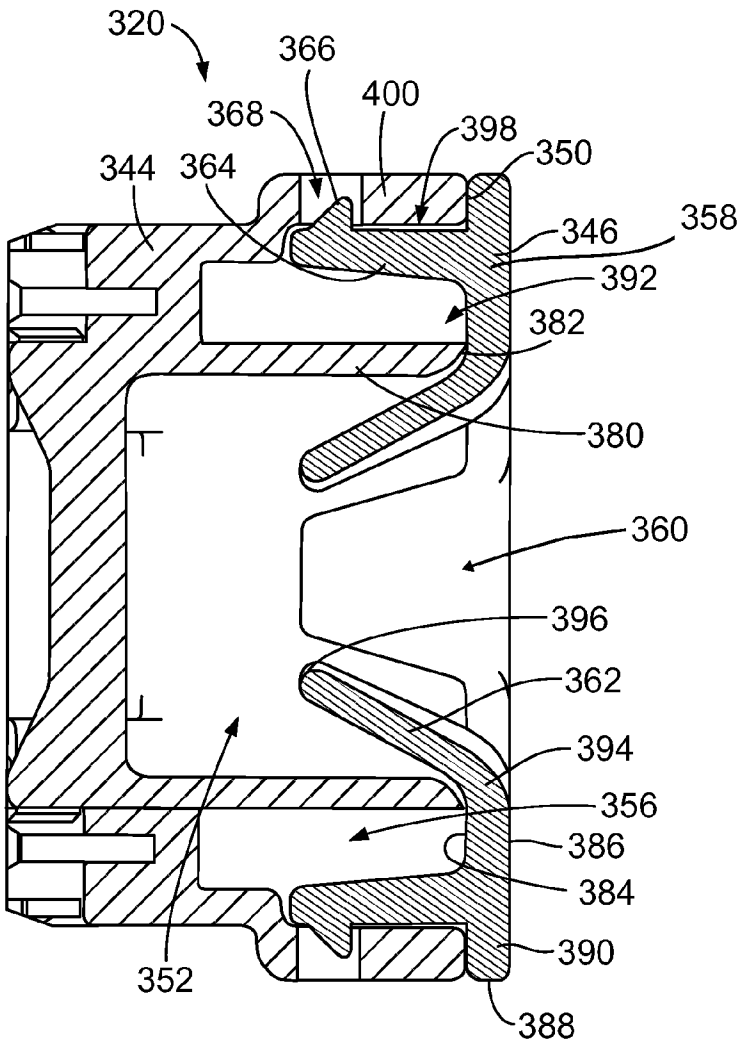
FIG. 11 is a cross sectional view of the strain relief assembly shown in FIG. 9.

FIG. 11 is a cross sectional view of the strain relief assembly 320 without the cable 342. FIG. 12 is a cross-sectional view of the strain relief assembly 320 with the cable 342 held by the strain relief assembly 320.

When assembled, the strain relief element 346 is coupled to the back housing 344 by the mounting tabs 364. In an exemplary embodiment, the latches 366 extend outward from the mounting tabs 364 into the latches 368 in the back housing 344 to secure the strain relief element 346 to the back housing 344. The mounting tabs 364 are received in the outer pockets 356 and the beams 362 are received in the cable bore 352. The back housing 344 includes inner walls 380 positioned between the mounting tabs 364 and the beams 362. The inner walls 380 extend to distal ends 382 that are flush with the rear end 350 of the back housing 344. The inner walls 380 separate the cable bore 352 from the outer pockets 356.

The end wall 358 of the strain relief element 346 is generally planar and includes an axially inner surface 384 and an axially outer surface 386. The opening 360 extends entirely through the end wall 358. Optionally, the opening 360 may be substantially centrally located within the end wall 358. The flexible beams 362 extend both radially and axially inward from the inner surface 384 at a non-perpendicular angle with respect to the end wall 358. As such, the beams 362 extend at least partially across the opening 360 and are configured to engage the cable 342 when the cable 342 is loaded through the opening 360. The mounting tabs 364 extend from a different portion of the end wall 358. For example, the mounting tabs 364 may extend axially inward from the inner surface 384 proximate to radially outer ends 388 of the end wall 358. Optionally, the mounting tabs 364 may extend substantially perpendicular from the end wall 358. The beams 362 may be non-parallel to the mounting tabs 364.

In the illustrated embodiment, the mounting tabs 364 are recessed slightly from the radially outer ends 388 such that a flange 390 is defined by the radially outer ends 388. The flange 390 abuts against the rear end 350 of the back housing 344. The flange 390 acts as a stop for the strain relief element 346 when loading the strain relief element 346 into the back housing 344. The flange 390 is positioned axially rearward or outward from the rear end 350.

In an exemplary embodiment, channels 392 are defined between the beams 362 and the mounting tabs 364. The end wall 358 defines a base of each channel 392. The width of the channel 392 depends on the distance of separation between the mounting tabs 364 and the beams 362. The width of the channel 392 may vary along the depth of the channel 392. The inner walls 380 of the back housing 344 are received within the channels 392 to separate the mounting tabs 364 from the beams 362. Optionally, the distal ends 382 of the inner walls 380 may engage the inner surface 384 of the end wall 358.

The beams 362 extend between fixed ends 394 and free ends 396. The fixed ends 394 are provided at the end wall 358. The free ends 396 are arranged within the cable bore 352. The beams 362 are cantilevered about the fixed ends 394. The beams 362 are movable or deflectable to allow the cable 342 to be loaded into the cable bore 352. For example, the beams 362 may be pivoted outward about the fixed ends 394 when the cable 342 is loaded into the cable bore 352.

During assembly, when the cable 342 is loaded into the strain relief assembly 320, the strain relief element 346 is deflected by the cable 342. The beams 362 are directly engaged by the cable 342 and are moved from a non-deflected position (shown in FIG. 11) to a deflected position (shown in FIG. 12). The amount of deflection depends on the diameter of the cable 342. Optionally, the inner walls 380 may define deflection limits for the beams 362. The beams 362 may be deflected until the beams 362 engage the inner walls 380. When deflected outward, the beams 362 are biased against the cable 342 and impart a normal force on the cable 342. The normal force may be great enough to hold the cable 342 and provide strain relief on the individual wires 340 of the cable 342. The free ends 396 of the beams 362 may dig into the jacket of the cable 342 or otherwise grip the cable 342.

In an exemplary embodiment, the mounting tabs 364 are also movable when the cable 342 is loaded into the cable bore 352. The mounting tabs 364 are movable between a normal position (shown in FIG. 11) when no cable 342 is loaded into the cable bore 352 and a deflected position (shown in FIG. 12) when the cable 342 is loaded into the cable bore 352. Optionally, the strain relief element 346 may be sized and shaped such that a gap 398 exists between the strain relief element 346 and an outer wall 400 of the back housing 344. When the mounting tabs 364 are moved to the deflected position, the gap 398 may be narrowed and/or eliminated entirely. For example, the mounting tabs 364 may engage the outer wall 400. In an exemplary embodiment, the deflection may be caused by the deflection of the beams 362. For example, the beams 362 may cause a bending moment about the inner wall 380 to flex the end wall 358, which may force the mounting tabs 364 to move, bend pivot and/or rotate. As the beams 362 are deflected by the cable 342, the end wall 358 is similarly deflected by the stresses imparted on the end wall 358 at the fixed ends 394. The end wall 358 may be bowed outward due to the deflection of the beams 362. Such deflection of the end wall 358 is also transferred to the mounting tabs 364. The mounting tabs 364 are forced outward toward an outer wall 400 of the back housing 344. Optionally, the mounting tabs 364 may be pivoted outward. The mounting tabs 364 may also be translated outward, such as if the cable 342 were to force the opening 360 to expand outward.

In the initial position, the mounting tabs 364 engage the back housing 344 with an initial latching force holding the strain relief element 346 within the back housing 344. For example, the latches 366 may engage the latches 368. In the deflected position, the mounting tabs 364 engage the back housing 344 with a secondary latching force that is greater than the initial latching force. For example, the latches 366 may be forced against the latches 368 and/or the mounting tabs 364 may be biased against the outer wall 400.

In an exemplary embodiment, the latches 366 are received within and engage the latches 368 in both the normal position and the deflected position. However, in the deflected position, the latches 366 may be more securely engage with the latches 368 or may be positioned further inside the latches 368, making the strain relief element 346 more securely secured to the back housing 344 and/or making it more difficult to remove the strain relief element 346 from the back housing 344.

Figure 13:
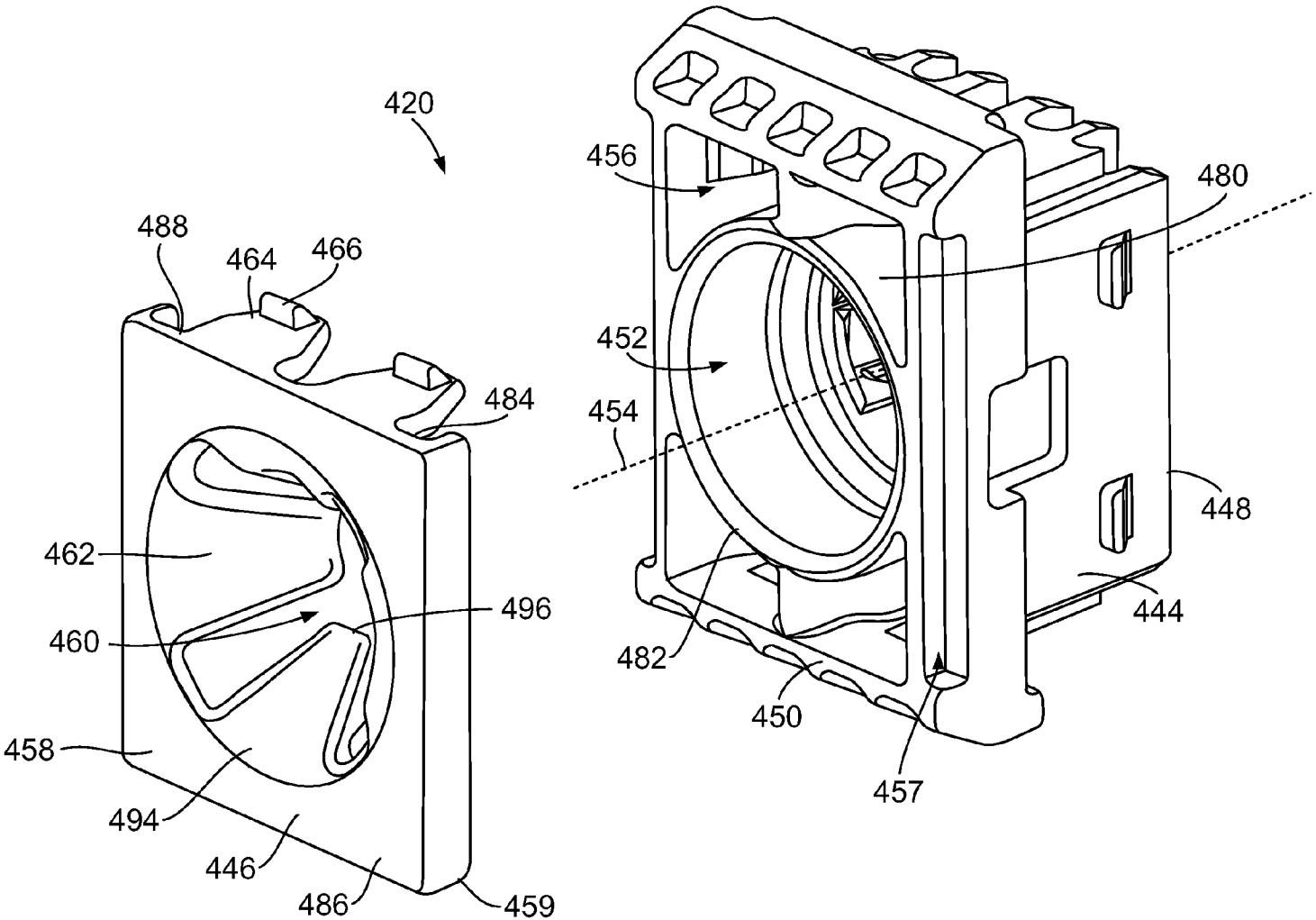
FIG. 13 is an exploded rear perspective view of an alternative strain relief assembly for the electrical connector.

FIG. 13 is an exploded rear perspective view of an alternative strain relief assembly 420 for an electrical connector. The strain relief assembly 420 may replace the strain relief assembly 320 (shown in FIG. 8) and be attached to a jack housing, similar to the jack housing 322 (shown in FIG. 8).

The strain relief assembly 420 includes a back housing 444 and a strain relief element 446 that is coupled to the back housing 444. The strain relief assembly 420 is configured to hold the cable (not shown) and/or the associated wires of the cable. The back housing 444 includes a dielectric body having a front end 448 and a rear end 450. A cable bore 452 extends axially between the front and rear ends 448, 450 along a bore axis 454. The cable bore 452 is configured to receive the cable in a loading direction along the bore axis 454. The cable bore 452 may be cylindrical in shape, or alternatively may have any other shape.

The back housing 444 includes outer pockets 456 positioned radially outward from, and surrounding portions of, the cable bore 452. In the illustrated embodiment, the outer pockets 456 are positioned both above and below the cable bore 452. The outer pockets 456 may be positioned elsewhere. The outer pockets 456 may entirely circumferentially surround the cable bore 452, or alternatively, may only surround select portions of the cable bore 452 such as in the illustrated embodiment. Optionally, only a single outer pocket 456 may be provided extending any circumferential distance around the cable bore 452. The outer pockets 456 are configured to receive a portion of the strain relief element 446, and may have any shape to accommodate such portion of the strain relief element 446. Optionally, the outer pocket 456 may be open along the radially outer portion of the outer pockets 456, such that no portion of the back housing 444 is positioned outward of the outer pockets 456. The outer pockets 456 may be defined outward of the outer perimeter of the back housing 444. Such an embodiment is similar to the embodiment illustrated in FIG. 7.

The back housing 444 also includes recesses 457 along the sides of the outer perimeter of the back housing 444. The recesses 457 may be open at the sides and/or at the rear. The recesses 457 are recessed from the rear surface of the back housing 444.

The strain relief element 446 includes an end wall 458. Rails 459 extend inward from the end wall 458 proximate to the sides of the end wall 458. The rails 459 are configured to be received within the recesses 457 of the back housing 444.

The strain relief element 446 also includes an opening 460 extending therethrough that is configured to receive the cable. The opening 460 extends through the end wall 458 and is aligned with the cable bore 452 along the bore axis 454. A plurality of flexible beams 462 and a plurality of mounting tabs 464 extend axially inward from the end wall 458. The mounting tabs 464 have latches 466 that engage the back housing 444 to secure the strain relief element 446 to the back housing 444. For example, the back housing 444 may include latches (not shown) that interact with the latches 466. In an exemplary embodiment, the mounting tabs 464 are received within the outer pockets 456. The flexible beams 462 are received within the cable bore 452. The mounting tabs 464 are separate and distinct from the flexible beams 462. The mounting tabs 464 extend from different portions of the end wall 458 are connected together by the end wall 458, as opposed to being directly connected to one another or part of the same structure.

When assembled, the strain relief element 446 is coupled to the back housing 444. The rails 459 are received in the recesses 457. The mounting tabs 464 are received in the outer pockets 456 and the beams 462 are received in the cable bore 452. The strain relief element 446 is secured to the back housing by the mounting tabs 464. In an exemplary embodiment, the latches 466 extend outward from the mounting tabs 464 into the latches 468 in the back housing 444 to secure the strain relief element 446 to the back housing 444. The back housing 444 includes inner walls 480 positioned between the mounting tabs 464 and the beams 462. The inner walls 480 extend to distal ends 482 that are flush with the rear end 450 of the back housing 444. The inner walls 480 separate the cable bore 452 from the outer pockets 456.

The end wall 458 of the strain relief element 446 is generally planar and includes an axially inner surface 484 and an axially outer surface 486. The opening 460 extends entirely through the end wall 458. Optionally, the opening 460 may be substantially centrally located within the end wall 458. The flexible beams 462 extend both radially and axially inward from the inner surface 484 at a non-perpendicular angle with respect to the end wall 458. As such, the beams 462 extend at least partially across the opening 460 and are configured to engage the cable when the cable is loaded through the opening 460. The mounting tabs 464 extend from a different portion of the end wall 458. For example, the mounting tabs 464 may extend axially inward from the inner surface 484 at radially outer ends 488 of the end wall 458. Optionally, the mounting tabs 464 may extend substantially perpendicular from the end wall 458. The beams 462 may be non-parallel to the mounting tabs 464. The rails 459 extend axially inward from the inner surface 484 proximate to the sides of the end wall 458.

The beams 462 extend between fixed ends 494 and free ends 496. The fixed ends 494 are provided at the end wall 458. The free ends 496 are arranged within the cable bore 452. The beams 462 are cantilevered about the fixed ends 494. The beams 462 are movable or deflectable to allow the cable to be loaded into the cable bore 452. For example, the beams 462 may be pivoted outward about the fixed ends 494 when the cable is loaded into the cable bore 452.

During assembly, when the cable is loaded into the strain relief assembly 420, the beams 462 are deflected outward by the cable. The rails 459 provide stiffness to the end wall 458 to resist deflection of the end wall 458. As such, the end wall 458 remains generally planar when the cable is loaded into the strain relief element 446. The strain relief element 446 may bow slightly such that the mounting tabs 464 move outward toward the back housing 444.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing including a rear end, the housing having a cable bore configured to receive a cable, and the housing having an outer pocket separate from, positioned radially outward from, and surrounding portions of, the cable bore; and a strain relief element coupled to the housing, the strain relief element including an end wall having an opening therein, the strain relief element including a flexible beam extending axially inward from the end wall proximate to the opening, the flexible beam being configured to engage the cable, the strain relief element having a mounting tab extending axially inward from the end wall and being spaced apart from the flexible beam, the mounting tab being received in the outer pocket and engaging the housing to secure the strain relief element to the housing.

2. The electrical connector of claim 1, wherein the housing includes an inner wall separating the cable bore from the outer pocket, the inner wall extending to the rear end of the housing.

3. The electrical connector of claim 1, wherein the housing includes an inner wall separating the cable bore from the outer pocket, the strain relief element engaging the inner wall such that as the cable deflects the flexible beams, the inner wall interacts upon the end wall to manipulate the position of the mounting tab with respect to the housing.

4. The electrical connector of claim 1, wherein the mounting tabs engage the housing with an initial latching force holding the strain relief element within the housing, and wherein the mounting tabs are movable toward the housing when the cable is loaded into the cable bore to engage the housing with a secondary latching force that is greater than the initial latching force.

5. The electrical connector of claim 1, a channel is created between the mounting tab and the flexible beam, the strain relief element being coupled to the housing such that a portion of the housing is received within the channel between the flexible beam and the mounting tab.

6. The electrical connector of claim 1, wherein the end wall includes an inner surface and an outer surface, the flexible beam extending inward at a non-perpendicular angle from the inner surface with respect to the end wall, the mounting tab extending inward from the inner surface.

7. The electrical connector of claim 1, wherein the rear end of the housing has an outer perimeter, the end wall of the strain relief element has an outer perimeter that is substantially the same as the outer perimeter of the rear end, the strain relief element being coupled to the housing such that the end wall is rearward of the rear end.

8. The electrical connector of claim 1, wherein the housing includes an outer wall defining a radially outer surface of the outer pocket, the mounting tab being movable between a normal position and a deflected position when the cable is loaded into the opening, in the normal position the mounting tab is spaced apart from the outer wall, in the deflected position the mounting tab is forced toward the outer wall.

9. The electrical connector of claim 1, wherein the strain relief element includes a plurality of flexible beams cooperating to hold the cable, the flexible beams being cantilevered from the end wall.

10. The electrical connector of claim 1, wherein the strain relief element includes a plurality of flexible beams, each of the flexible beams having a fixed end at the end wall and a free end arranged within the cable bore, the free ends being deflected away from one another when the cable is loaded into the cable bore.

11. An electrical connector comprising:

a strain relief assembly including a housing and a strain relief element coupled to the housing, the strain relief element including an end wall having an opening and a flexible beam extending from the end wall for engaging a cable received in the opening, the strain relief element having a mounting tab extending from the end wall, the mounting tab having a latch engaging the housing, the mounting tab being separate from the flexible beam such that a channel is created between the mounting tab and the flexible beam, the strain relief element being coupled to the housing such that a portion of the housing is received within the channel between the flexible beam and the mounting tab, and wherein the housing includes a cable bore configured to receive the cable and an outer pocket separate from, positioned radially outward from, and surrounding portions of, the cable bore, the flexible beam being received in the cable bore, the mounting tab being spaced apart from the flexible beam and being received in the outer pocket and engaging the housing to secure the strain relief element to the housing.

12. The electrical connector of claim 11, wherein the housing includes a wall defining the portion of the housing received within the channel, a distal end of the wall engaging the end wall of the strain relief assembly.

13. The electrical connector of claim 11, wherein the mounting tab extends perpendicular from the end wall, the flexible beam being oriented at a non-perpendicular angle with respect to the end wall.

14. The electrical connector of claim 11, wherein the flexible beam is movable between an undeflected position and a deflected position, the flexible beam being movable independently of the mounting tab.

15. The electrical connector of claim 11, wherein the housing includes a wire organizer including a plurality of slots configured to receive and hold individual wires of the cable, the housing being coupled to a jack housing that holds a plurality of contacts such that the contacts engage the wires held by the wire organizer when the housing is coupled to the jack housing.

16. The electrical connector of claim 11, wherein the cable bore is open at a rear end of the housing and the outer pocket is open at the rear end of the housing, the flexible beam being received in the cable bore, the mounting tab being received in the outer pocket and engaging the housing to secure the strain relief element to the housing.

17. The electrical connector of claim 11, wherein said cable bore opens at rear end of the housing and configured to receive the cable, and wherein the end wall is parallel to, and extends along, the rear end of the housing, portions of the end wall covering the rear end.

18. An electrical connector comprising:

a jack housing having a mating end and a wire terminating end;

a contact sub-assembly received in the jack housing, the contact sub-assembly having a plurality of jack contacts, the jack contacts being configured to engage mating contacts of a mating plug;

a wire termination sub-assembly received in the jack housing, the wire termination sub-assembly having a plurality of contacts that are configured to be electrically coupled to the jack contacts and to wires of a cable; and a strain relief assembly coupled to the jack housing, the strain relief assembly having a back housing and a strain relief element coupled to the back housing, the strain relief element including an end wall having an opening and a flexible beam extending from the end wall for engaging the cable received in the opening, the strain relief element including a mounting tab separate from the flexible beam and extending from the end wall such that a channel is created between the mounting tab and the flexible beam, the strain relief element being coupled to the back housing such that a portion of the back housing is received within the channel between the flexible beam and the mounting tab, the flexible beam being deflected when the cable is received in the opening to provide a biasing force on the cable, the back housing having a wire organizer including a plurality of slots configured to receive and hold individual wires of the cable, the back housing being coupled to the wire terminating end of the jack housing such that the contacts of the wire termination sub-assembly engage the wires held by the wire organizer when the back housing is coupled to the jack housing.

19. The electrical connector of claim 18, wherein the back housing includes a cable bore configured to receive the cable and an outer pocket positioned radially outward from, and surrounding portions of, the cable bore, the flexible beam being received in the cable bore, the mounting tab being received in the outer pocket and engaging the housing to secure the strain relief element to the back housing.

20. The electrical connector of claim 18, wherein the strain relief assembly is at least partially manufactured from a conductive material, the strain relief element being configured to engage a shield of the cable, the strain relief assembly at least one of providing shielding for the electrical connector and completing a grounding path between the cable and the electrical connector.

21. The electrical connector of claim 18, wherein the mounting tab, the channel and the flexible beam are aligned with one another forward of the end wall, the flexible beam being at least partially deflected into the channel when the cable is received in the opening.

22. The electrical connector of claim 18, wherein the strain relief element is separate and discrete from the back housing, the strain relief element being attached to the back housing by the mounting tabs.

* * * * *